US005343944A

United States Patent [19]

Bassinger

[11] Patent Number: 5,343,944

[45] Date of Patent: Sep. 6, 1994

[54] SELF ALIGNING STUFFING BOX FOR PUMPJACK UNITS

[76] Inventor: Grey Bassinger, 1308 S. Midkiff, Ste. 125, Midland, Tex. 79701

[21] Appl. No.: 942,897

[22] Filed: Sep. 10, 1992

[51] Int. Cl.[5] ..... E21B 33/03

[52] U.S. Cl. ..... 166/84; 277/30

[58] Field of Search ..... 166/84, 170, 72, 176; 251/1.1, 1.2; 277/15, 2, 28; 417/390

[56] References Cited

U.S. PATENT DOCUMENTS

| | | | |
|---|---|---|---|
| 3,468,374 | 9/1969 | Reeves | 166/84 |
| 3,887,196 | 6/1975 | Renfrow | 277/2 |
| 3,939,910 | 2/1976 | Bruce | 166/84 |
| 3,967,678 | 7/1976 | Blackwell | 277/28 X |
| 4,099,562 | 7/1978 | Mattoon | 166/84 |
| 4,889,184 | 12/1989 | Lugtmeier et al. | 166/84 |
| 4,981,174 | 1/1991 | White | 166/84 |
| 5,137,083 | 8/1992 | Bump | 166/84 |
| 5,217,068 | 6/1993 | Newton | 166/84 |

*Primary Examiner*—Ramon S. Britts
*Assistant Examiner*—Frank S. Tsay
*Attorney, Agent, or Firm*—Marcus L. Bates

[57] ABSTRACT

A self aligning stuffing box for a pumpjack unit of the type having a polished rod reciprocatingly extending therethrough and downhole to a pump located at the lower end of the borehole. The stuffing box is an annular main body having a tubing adaptor at the lower end by which it can be mounted to the upper end of a well bore. A spool receiving cavity is located within the main body concentrically respective to the polished rod, and an annular spool is received within the cavity. The polished rod reciprocatingly extends through the spool and main body. A seal assembly is mounted to the inner surface of the spool for sealingly engaging the polished rod. The spool cooperates with the cavity to form a lubrication chamber that extends outwardly and about the spool. The spool moves within the spool receiving cavity radially of the passageway to align the polished rod with the wellbore. The adaptor forms a pack-off that isolates the seal from the wellbore, and provision is made by which the seal assembly can be replaced without removing the polished rod from the pumpjack unit.

20 Claims, 3 Drawing Sheets

SELF ALIGNING STUFFING BOX FOR PUMPJACK UNITS

BACKGROUND OF THE INVENTION

In the production of crude oil from an oil well, it is often necessary to employ artificial lift devices by which the crude oil is lifted up the borehole to the surface of the ground where the crude oil is stored in a tank farm. Usually a pumpjack unit is employed for this purpose and there are some geographical locations where there are more pumpjack units than people. There are those who have spent an entire lifetime studying pumpjack units, and such people are profoundly informed on this subject. The pumpjack units are responsible for a significant amount of the crude oil produced in the USA.

Most pumpjack units include a stuffing box for reciprocatingly receiving a polished rod in sealed relationship therewith. The polished rod is connected to a string of sucker rod that extend downhole to actuate a downhole pump. The seals of the stuffing box become worn with extended usage and must be replaced from time to time and before the produced crude oil is spilled onto the ground. Misalignment between the pumpjack unit and the wellbore causes accelerated wear of the stuffing box seal apparatus. A leaky stuffing box contaminates the surroundings and has often created serious environmental problems when left unattended for long time intervals.

In the past it has been necessary to discontinue production of the well apparatus and to disconnect the polished rod from the horsehead in order to replace the seal apparatus of the stuffing box. Sometime a pack-off is temporarily installed between the polished rod and tubing string to shut in the well and to avoid emitting dangerous gases into the atmosphere. Hence the task of replacing the seals in the stuffing box of a pumpjack unit can become an arduous, time consuming, expensive undertaking.

Self aligning stuffing boxes for pumpjack units have been offered to the industry for many years. The present invention is an improvement over these prior art devices and provides a useful and novel self aligning stuffing box for the polished rod of a pumpjack unit. The improved stuffing box of this invention includes a pack-off in combination therewith by which the borehole annulus is packed off from the stuffing box and thereby enables the stuffing box to be opened and serviced without resorting to the necessity of using a workover rig for killing the well.

Further, the present invention provides a stuffing box having self aligning features in combination with a novel oil reservoir that elongates the expected life of the components of the stuffing box. Moreover, the present invention teaches a self aligning stuffing box having an oil reservoir associated therewith, and means that senses seal failure and provides a signal in response thereto by which the motor controller of the pumpjack unit is de-energized thereby eliminating operation of a hot stuffing box. This unusual and novel feature of the invention eliminates contamination of the well site with crude oil and related products.

SUMMARY OF THE INVENTION

A self aligning stuffing box has a seal assembly therewithin that forms a wall of an oil reservoir. A wellhead adaptor supports the stuffing box in fixed relationship respective to a wellhead. The adaptor has a packoff included therein that can be actuated to pack off the annular area between the polished rod and the interior of the tubing string, thereby precluding flow from the well bore. A reciprocating polished rod extends in sealed relationship through the stuffing box, the seal assembly, and lo through the pack-off.

The stuffing box includes a main body which receives a removable closure member at the upper end thereof, and a downwardly extending part that is rotatable and threadedly mounted respective to an upper end of the adaptor. The lower end of the adaptor is fastened to the upper end of the production string.

The closure member and main body form a spool receiving chamber therewithin. The spool receiving chamber also forms a lubrication chamber between the spool and the main body. A seal chamber is formed interiorly of the spool. The spool, main body, and closure member cooperate in sealed relationship respective to one another such that the axial passageway through the spool reciprocatingly receives the polished rod in sealed relationship therewith. The spool is received for horizontal movement within the spool receiving chamber in a manner such that the axial passageway of the stuffing box can be moved eccentrically in a horizontal plane to accommodate misalignment between the pumpjack horsehead and the vertical axial bore of the borehole.

A unique seal assembly comprising commercially available seal components is mounted within the seal chamber. Spare seal components are carried by the reciprocating polished rod and are available for use any time one desires to replace the operating seals.

The pack-off unit is mounted below the self aligning stuffing box. The pack-off is actuated by rotating the main body of the stuffing box respective to the wellhead adaptor. This action expands the pack-off device into the annulus between the polished rod and the wellhead adaptor, thereby isolating the lower tubing annulus from the seal assembly.

A primary object of this invention is the provision of an improved stuffing box having seal means mounted respective to a spool and contained within the main body thereof, with there lo being an oil reservoir formed within the main body and outwardly of the spool.

Another object of this invention is the provision of a stuffing box for a pumpjack unit, with there being an oil reservoir formed within the main body of the stuffing box and outwardly of a seal means contained within the main body thereof, and means connected to the oil reservoir to provide a signal upon failure of the seal assembly.

Still another object of the present invention is the provision of a stuffing box having self aligning features in combination with a novel oil reservoir that elongates the expected life of the seal means associated with the stuffing box.

A still further object of this invention is to provide a self aligning stuffing box having an oil reservoir associated therewith that senses seal failure and provides a signal in response thereto by which a motor controller of a pumpjack unit is de-energized thereby eliminating operation of a hot stuffing box.

A further object of this invention is to disclose and provide a self aligning stuffing box for a pumpjack unit that can be mounted to the upper end of a tubing string, and a seal assembly mounted therewithin, and a second seal assembly mounted therewithout and to the polished rod; and means by which the second seal assembly can be substituted for the seal assembly mounted therewithin.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
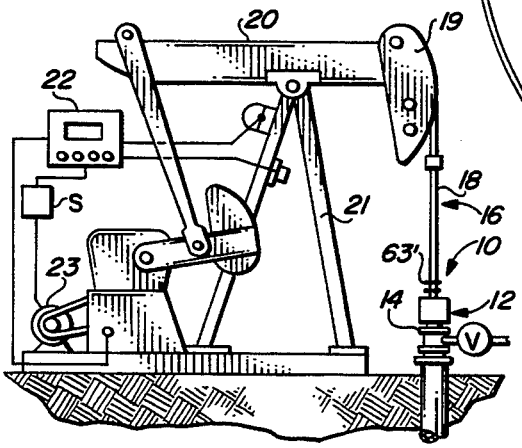
FIG. 1 is a partial, side elevational view of a prior art pumpjack unit diagrammatically showing the stuffing box and packer apparatus of this invention in combination therewith.

FIG. 1 discloses the combination 10 of a self aligning stuffing box 12 and wellhead adaptor 14, made in accordance with the present invention. The improved stuffing box 12 is supported by the novel wellhead adaptor 14. The wellhead adaptor also serves as a pack-off for working on the stuffing box 12, as will be more fully appreciated later on herein.

Numeral 16 diagrammatically indicates a prior art pumpjack unit having the usual polished rod 18 that is reciprocated by horsehead 19 of oscillating rocking beam 20, which in turn is supported by Sampson post 21. Controller 22 is connected to motor starter S for controlling the operation of a high slip pumpjack motor 23.

In the other figures of the drawings, wherein like or similar numerals indicate like or similar elements, wherever it is possible or logical to do so, numeral 24 indicates a closure member attached to a main body 25 of stuffing box 12. Wrench detent 26 is spaced circumferentially about closure member 24. Annular shoulder 27 is opposed to face 24' and is abuttingly engaged by annular shoulder 28 that forms the upper terminal end of the main body 25. A roof in the form of an annular face 30 is parallel to annular face 24' and to the annular shoulder 27.

Threads 32 are formed between the co-acting interface of the main body 25 and closure member 24. O-ring seal 34 precludes leakage of fluid thereacross. Upper oil reservoir 36 has a lower passageway 38 leading into a spool receiving chamber that also forms a lower oil reservoir 40.

Numeral 42 indicates the inner axial passageway that extends through the closure member and the main body. Annulus 44 is formed between the closure member and the polished rod 18.

Spool 46 is of annular construction and includes an outwardly opening annular area 48 that cooperates with the other parts of the stuffing box to form the before mentioned lower oil reservoir 40. Passageway 49 radially extends toward a special seal assembly 50 which sealingly receives polished rod 18 through the central axis thereof. Opposed upper and lower spool faces 52, 53 are slidably received against opposed faces presented by roof 30 and floor 54 of the lower oil reservoir 40. Circumferentially extending sides 55, 56 are inwardly spaced from the inner wall surface 33 of the lower oil reservoir 40, O-ring seals 57 and 58 sealingly engage the interface between surfaces 53, 54 and 30, 52. Passageway 59 exposes the lower end of the seal assembly 50 to facilitate disassembly thereof.

Numeral 60 indicates a seal chamber within which the before mentioned seal assembly 50 resides. Numeral 62 is a special annular separator and lubricating member which can be continuous or split as deemed desirable, the details of which are more fully explained later on. Seals 63, located on opposed sides of separator 62, are commercially available, elastomeric products, The wall of axial bore 64 is slightly spaced from the outer surface of the polished rod. Numeral 66 is a heavy, thick, split, annular washer that abuttingly engages groove 68 of the spool in order to form an annular chamber therebelow within which seal assembly 50 is received.

The main body of the stuffing box 12 of the present invention terminates in an inclined conical surface 70. Co-acting threaded surfaces 72 are located between upper shoulder 74 that forms the upper terminal end of wellhead adaptor 14, and the lower cone 78. O-ring 76 precludes leakage between the two co-acting parts 12, 14. Lower inclined conical surface 78 is axially aligned with conical surface 70 and the counter bore of the apparatus and spaced from the co-acting cone 70. An elastomeric packoff 80 of annular construction is captured between cones 70, 78. The cones 70, 78 are moved toward and away from one another when stuffing box 12 is rotated respective to the wellhead adaptor 14. The combination stuffing box and pack-off device ends at lower terminal end 84. Threads 86 engage the upper end of the tubing string at the wellhead and support the adaptor 14, while the stuffing box 12 threadedly engages adaptor 14 and is supported therefrom. An axial passageway extends longitudinally through the entire apparatus through which the polished rod 18 is reciprocatingly received.

Numeral 88 is a free floating, annular, holding device within which there is received a wiping element which can take on any number of different forms, such as a resilient washer or the illustrated brush 90. The brush 90 has bristles 92 extending radially from the axial centerline of the passageway. Numeral 94 indicates the wiping interface between the brush and the polished rod 18. Numeral 96 indicates the interface between member 88 and upper face 24. The brush, 90, 92 can be replaced easily without disassembly of the apparatus. The brush, 90, 92 is discontinuous to facilitate replacement thereof. The seal assembly 50 can pass axially through the holding device 88.

A fluid conduit 98 extends from upper oil reservoir 36 to a pressure actuated switch means 99. Pressure switch means 99 provides an electrical signal related to the seal condition and is connected to control apparatus 100 which in turn is connected to cause the motor controller 22 to de-energize the pumpjack motor. The pumpjack motor controller 22 de-energizes the pumpjack motor 23 whenever there is a pressure increase of a predetermined magnitude within lubrication reservoirs 36 and 40 due to seal failure. The increase can be 25% above the normally expected pressure, for example only.

Figure 3:
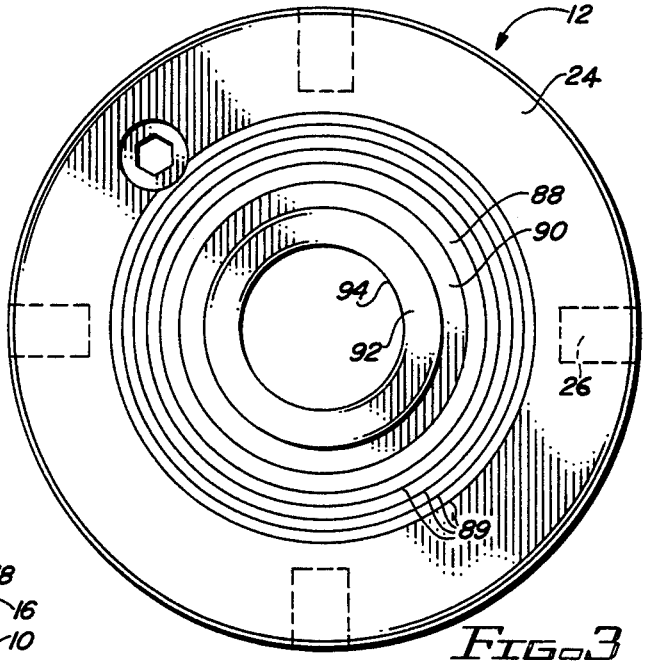
FIG. 3 is a top, plan view of the apparatus disclosed in FIG. 5.
Figure 4:
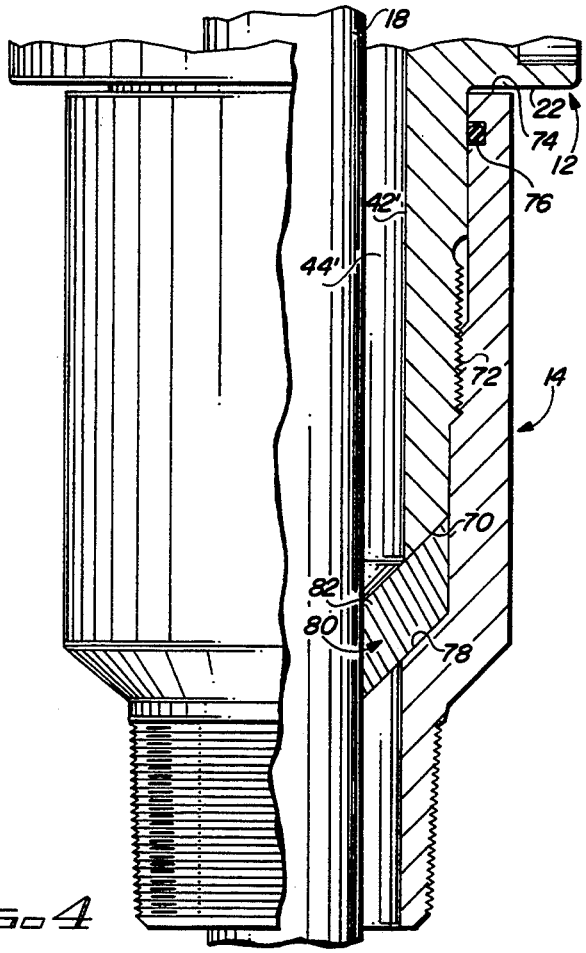
FIG. 4 is a fragmentary, representation of part of the apparatus of FIGS. 2 and 5, showing the apparatus in an alternate position of operation; and, FIG. 5 is an enlarged, longitudinal, cross-sectional view of the present invention.

In FIG. 3, circumferentially extending scribe marks 89 having indicia formed thereon related to eccentricity between the stuffing box of the present invention and the horsehead of the pumpjack unit. The circumferentially extending scribe marks 89 are useful in jacking the pumpjack unit into alignment with the stuffing box and therefore with the longitudinal axis of the borehole.

Numerals 63, 63' indicate seal elements, which can include one or more of the seal assemble 50, if desired. The seals stored at 63' move with the sucker rod and may be protected by encapsulation within a suitable resilient material such as polyethylene and the like. The seals stored at 63' may be taped to the sucker rod until needed, for example.

In operation, opposed face of the spool 46 abut opposed surfaces 30 and 54 as the closure member 24 is made up against seals 57 and 58. This isolates the upper and lower oil reservoirs 36 and 40 from ambient.

Figure 5:
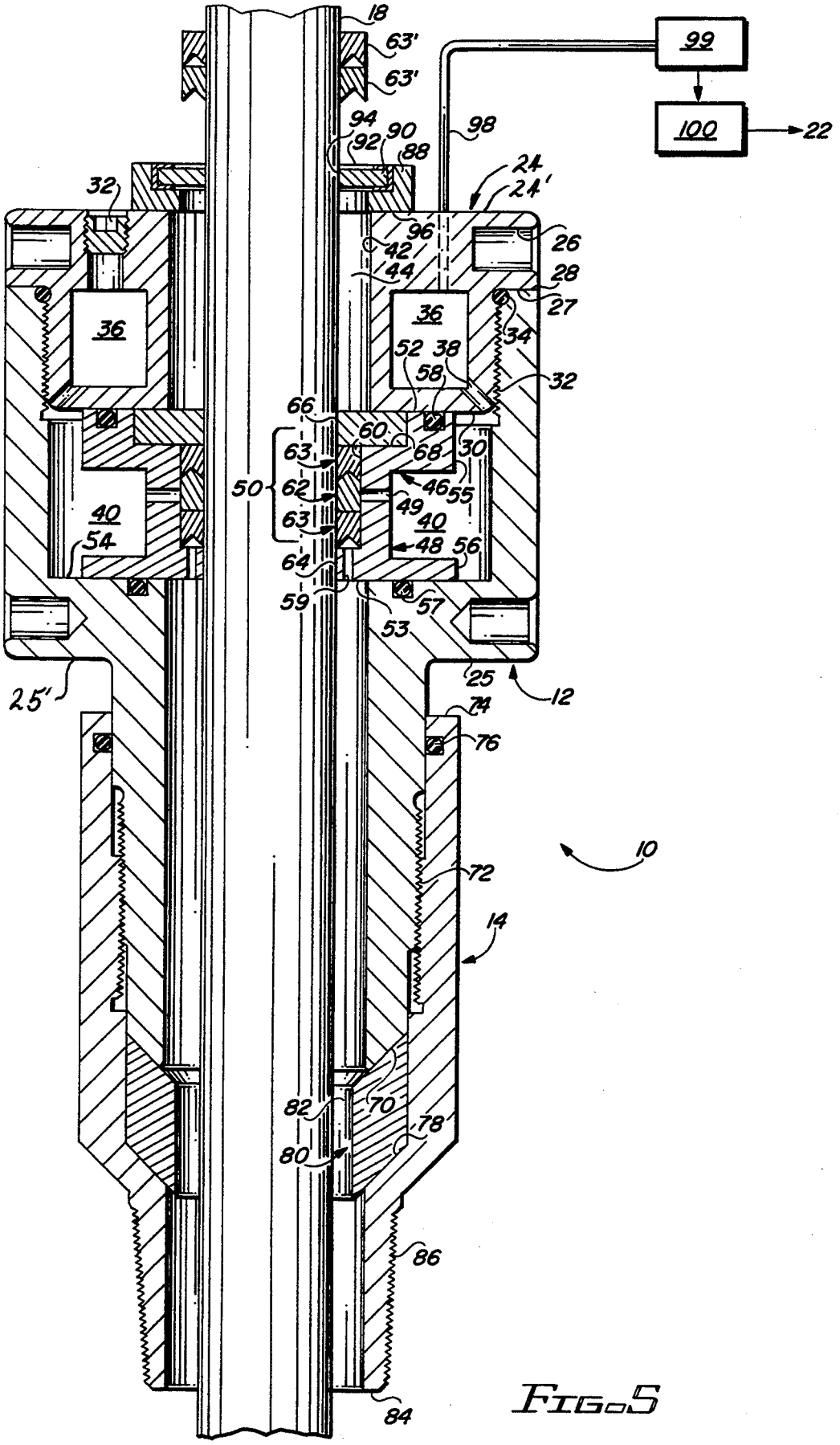

Seal assembly 50 is placed within the annular seal cavity of the spool, annular washer 66 is seated in the illustrated manner of FIG. 5, and the closure member 24 is made up. Brush apparatus 90 is positioned within brush holder 88 and positioned in the illustrated manner of FIG. 5 so that debris is brushed from the polished rod surface.

The apparatus is fabricated such that annular shoulders 27 and 28 abuttingly engage one another while leaving sufficient tolerance between interfaces 30, 52 and 53, 54 for the spool and washer 66 to be moved towards and away from the axial centerline of the borehole as may be required to achieve proper alignment of the co-acting parts, while at the same time seals 57 and 58, respectively, sealingly engage the adjacent surfaces 30 and 54, respectively.

Annulus 44' is in communication with the upper end of the production tubing and accordingly there is usually a pressure in excess of atmospheric effected at passageway 59. This places a positive pressure on lower seal member 63 which urges the seal assembly 50 uphole against washer 66 in proportion to the pressure drop thereacross. Should the seal assembly 50 commence failure, there will be leakage through passageway 59, through the damaged seal assembly 50, through passageway 49, into the lower oil reservoir 40, thereby elevating the pressure within the upper reservoir 36. This elevated pressure is sensed at 99 and the resultant signal is delivered to circuitry 100 which in turn is connected to cause controller 22 to shut off motor 23 by telling the starter S thereof not to start the pumpjack again.

The upper oil reservoir 36 is filled by removing the filler plug 37. The seal assembly 50 is easily replaced by first setting the pack-off or packer element 80. This is achieved by screwing the main body 25 respective to the adaptor 14 to cause shoulders 25' and 74 to move towards one another as the threads at 72 are made up. This action causes cones 70 and 78 to be moved axially toward one another, thereby compressing the elastomeric material of pack-off 80 between the cones and against the polished rod to seal or pack-off the tubing pressure from annulus 44'. Next, the closure member is engaged at wrench detent 26 with a suitable wrench and unthreaded at 32 whereupon the closure member can be lifted free of the main body. The entire seal assembly along with the spool and split washer 66 can be lifted from the interior of the main body. At this time, lubricant from the oil reservoir will gravitate into the annular area located above the packoff.

Figure 2:
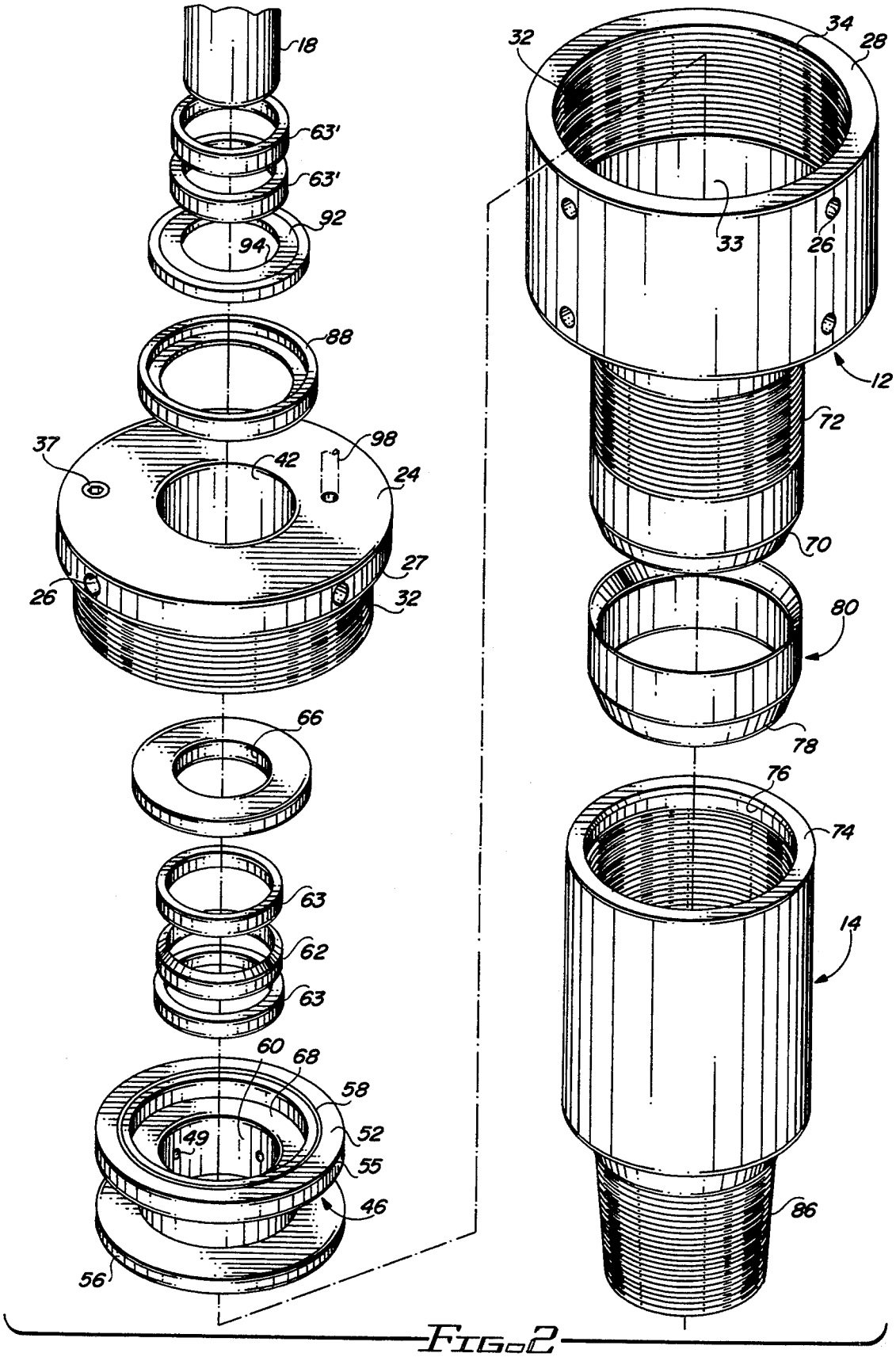
FIG. 2 is an exploded view of the preferred embodiment of the invention as seen illustrated in FIG. 5.

The split washer, being bisected into halves, is exposed and can be removed easily from the seat formed by the circumferentially extending groove at 68 and set aside. Seal assembly 50 can now be are removed from the seal cavity, and then cut to enable removal from the polished rod, and then discarded. The compressed, sponge-like, stainless steel, annular separator or spacer member 62 can be split or continuous. When split, the separator 62 is easily deformed or twisted and removed from the polished rod. The lower seal 63' is moved down the polished rod into position in the bottom of the seal chamber, the spacer member 62 along with remaining seal 63' placed within the seal chamber, the split washer 66 replaced in the illustrated position of FIG. 2, whereupon threads 32 of the closure member can be made up. The oil reservoirs are topped off with clean lubricant after which the main body is rotated back into the configuration of FIG. 2, thereby releasing the packoff 80 from the polished rod, as its memory returns it to normal configuration. The pumpjack unit resumes operation with a new seal assembly in place.

Several seal assemblies 63' may be stored on the polished rod as shown until needed. The stored seal assembly can include the two seal elements 63' with an unused sponge metal continuous spacer 62 therebetween. The stored seal assemblies can be protected by encapsulation within suitable protective plastic material. The stored seal assemblies 63' ride on the polished rod until needed.

The combination of the novel stuffing box, packer apparatus, and stored seal assembly provides a new combination having unobvious patentable features that reduce the cost of producing an oil well with a pump jack unit.

I claim:

1. A self aligning stuffing box for a pumpjack unit of the type having a polished rod reciprocatingly extending therethrough and downhole into a borehole; said stuffing box comprising:

an annular main body having an upper end opposed to a lower end, a closure member at the upper end, and adaptor means at the lower end by which said stuffing box can be mounted respective to the borehole;

a spool receiving cavity formed within said main body, a shoulder within said main body that forms a cavity floor, an annular spool received within said spool receiving cavity through which the polished rod reciprocatingly extends; said spool having inner and outer surfaces and upper and lower faces, a seal assembly mounted to the inner surface of the spool for sealingly engaging the polished rod; whereby, said spool can move within said spool receiving cavity radially of said cavity and thereby align the polished rod with the borehole;

an oil reservoir formed within the spool receiving cavity and outwardly of the spool;

said closure member has a lower face, seal means by which said upper face of said spool engages said lower face of said closure member; and seal means by which said lower face of said spool engages said lower shoulder of the main body.

2. The stuffing box of claim 1 wherein the lower end of the main body terminates in a conical face; a conical face on the adaptor spaced from the main body conical face; a resilient pack-off member between the conical faces; a threaded member between the conical faces by which the conical faces are forced to move axially towards one another while compressing the pack-off member therebetween and into sealing engagement with the polished rod;

whereby:

rotation of the main body compresses the packoff which seals the annulus located between the tubing and the polished rod.

3. The stuffing box of claim 1 wherein there is an active and a spare seal means, said active seal means is the recited seal located in the spool; said spare seal means is attached to the polished rod at a location above the stuffing box;

whereby:

said active seal means can be removed from the spool and the spare seal means substituted therefor.

4. The stuffing box of claim 1 and further including:

a pressure actuated switch means and circuit means connected to measure the pressure in said oil reservoir and for deenergizing the pumpjack unit upon the pressure measured within the oil reservoir reaching a predetermined magnitude.

5. The stuffing box of claim 1 wherein said seal comprises upper and lower spaced annular resilient seal members having a porous oiling member therebetween, and passageway means connected to the porous oiling member and lubrication reservoir for lubricating the seal assembly and the polished rod.

6. An improved stuffing box for a pumpjack unit of the type having a polished rod reciprocatingly received through the stuffing box in a sealed manner therewithin for producing a wellbore comprising:

a passageway extending through said stuffing box through which the polished rod is reciprocatingly received; said passageway includes an inner wall surface that defines an upwardly opening annular chamber within said stuffing box that is aligned in parallel relationship respective to said axial passageway; a closure member affixed to the upper end of said chamber;

an annular spool having opposed flanges; a spool passageway axially aligned with the polished rod; seal means mounted within said spool passageway for sealingly engaging the reciprocating polished rod; said spool is received within said chamber and forms a lubrication chamber between said spool and the inner wall surface to permit movement of said spool radially of said chamber and thereby align the polished rod with the wellbore.

7. The stuffing box of claim 6 wherein there is further included a wellhead adaptor by which the lower end of said stuffing box can be mounted respective to the upper end of the wellbore;

means forming a conical face at the lower end of the stuffing box; means forming a conical face within the adaptor spaced from the stuffing box conical face; a pack-off means located between the spaced conical faces; conduit means connected between the spaced conical faces by which the conical faces are forced to move axially towards one another while compressing the pack-off therebetween and into sealing engagement with the polished rod.

8. The apparatus of claim 6 wherein there is an active and a spare seal means, said active seal means is the recited seal located in the spool; said spare seal is attached to the polished rod at a location above the stuffing box;

whereby:

said active seal means can be removed from the spool and the spare seal means substituted therefor.

9. The stuffing box of claim 6 wherein said adaptor can be connected to the upper end of a tubing string of a wellbore; the lower end of the stuffing box terminates in a conical face; a conical face on the adaptor spaced from the stuffing box conical face; an annular resilient pack-off means having opposed ends mounted for engagement with respect to the spaced conical faces whereby produced fluid normally flows through the interior of the pack-off; conduit means connected between the spaced conical faces by which the spaced conical faces are forced to move axially towards one another while compressing the pack-off therebetween and into sealing engagement with respect to the polished rod and the interior wall of the tubing string, thereby precluding flow of production fluid from the wellbore.

10. The stuffing box of claim 6 wherein there is an active and a spare seal means, said active seal means is the recited seal located in the spool; said spare seal is attached to the polished rod at a location above the stuffing box;

each seal means includes upper and lower seal members having a porous lubricating spacer therebetween, passageway means by which lubrication flows from said lubrication chamber to said spacer to lubricate the seal means and the polished rod.

11. The stuffing box of claim 6 wherein said lubrication chamber has circuit means including a pressure actuated switch means connected to measure the pressure in said oil reservoir and for rendering the pumpjack unit inoperative upon the pressure measured within the oil reservoir reaching a predetermined magnitude.

12. The apparatus of claim 6 wherein said seal comprises upper and lower spaced annular resilient seal members having a porous oiling member therebetween, and passageway means connected to the porous oiling member and lubrication reservoir for lubricating the seal assembly and the polished rod.

13. In a pumpjack unit having a polished rod reciprocatingly received through a stuffing box in a sealed manner therewithin; the stuffing box being attached to the upper end of 4 a production tubing string by an adaptor; the combination of said stuffing box and adaptor comprising:

an upwardly opening annular chamber within said stuffing box; a passageway extending through the annular chamber and through said stuffing box through which the polished rod is reciprocatingly received; a closure member for said stuffing box, said closure member forms a chamber roof, a floor in said stuffing box that forms a bottom of the annular chamber;

an annular spool having a spool passageway and opposed flanges; a seal assembly mounted in the spool passageway for reciprocatingly receiving the polished rod; said spool is received within said chamber with said opposed flanges, respectively, slidably engaging the roof and floor, respectively, of said annular chamber; said chamber has an interior wall spaced from said spool, a lubrication chamber jointly formed by said spool, said interior wall, and said chamber roof and floor within which the spool can move radially of said chamber wall and thereby align the polished rod with the production tubing string.

14. The combination of claim 13 wherein the lower end of the stuffing box terminates in a conical face; a conical face on the adaptor spaced from the stuffing box conical face; an annular resilient pack-off means having opposed ends mounted for engagement with respect to the spaced conical faces whereby produced fluid normally flows through the interior of the pack-off; a fluid conveying conduit means having a threaded surface thereon for threadedly engaging the upper end of the tubing string and the lower end of the stuffing box and thereby move the spaced conical faces axially towards one another while compressing the pack-off therebetween and into sealing engagement with the polished rod;

whereby:

rotation of the main body compresses the packoff which seals the annulus located between the tubing string and the polished rod.

15. The combination of claim 13 wherein there is an active and a spare seal means, said active seal means is the recited seal located in the spool; said spare seal is attached to and reciprocates with the polished rod at a location above the stuffing box;

whereby:

said active seal means can be removed from the spool and the spare seal means substituted therefor.

16. The combination of claim 13 wherein said adaptor can be connected to the upper end of a tubing string; the lower end of the main body terminates in a conical face; a conical face on the adaptor spaced from the main body conical face; a threaded surface between the conical faces by which the conical faces are forced to move axially towards one another while compressing the pack-off therebetween and into sealing engagement with the polished rod;

whereby:

rotation of the main body compresses the packoff which seals the annulus located between the tubing and the polished rod.

17. The combination of claim 13 wherein there is an active and a spare seal means, said active seal means is the recited seal located in the spool; said spare seal means is stored on the polished rod at a location above the stuffing box;

whereby:

said active seal means can be removed from the spool and the spare seal means substituted therefor.

18. The combination of claim 13 wherein said seal comprises upper and lower spaced annular resilient seal members having a porous oiling member therebetween, and passageway means connected to the porous oiling member and lubrication reservoir for lubricating the seal assembly and the polished rod.

19. The combination of claim 17 wherein said closure member has an upper lubrication chamber formed therein, passageway means connecting the first recited lubrication chamber with said upper lubrication chamber.

20. The combination of claim 13 wherein said lubrication chamber has a pressure actuated switch means connected for de-energizing the operation of the pumpjack;

and means that senses seal failure and provides a signal in response thereto by which the pumpjack unit is de-energized thereby eliminating operation of a hot stuffing box so that contamination of the well site is obviated.

* * * * *